US007488234B2

(12) United States Patent
Rothman et al.

(10) Patent No.: US 7,488,234 B2
(45) Date of Patent: Feb. 10, 2009

(54) GARMENT WITH SHELF BRA HAVING IMPROVED BREAST SUPPORT

(76) Inventors: Line Rothman, 2 Laurel St., Rye, NY (US) 10580; Michael Rothman, 2 Laurel St., Rye, NY (US) 10580

( * ) Notice: Subject to any disclaimer, the term of this patent is extended or adjusted under 35 U.S.C. 154(b) by 0 days.

(21) Appl. No.: 11/457,811

(22) Filed: Jul. 16, 2006

(65) Prior Publication Data

US 2008/0026676 A1 Jan. 31, 2008

(51) Int. Cl.
*A41C 3/00* (2006.01)

(52) U.S. Cl. ..... 450/36; 2/104; 2/69

(58) Field of Classification Search ..... 450/54–58, 450/36, 37, 7–32
See application file for complete search history.

(56) References Cited

U.S. PATENT DOCUMENTS

| | | | | |
|---|---|---|---|---|
| 2,127,927 | A * | 8/1938 | McCabe | 450/36 |
| 4,398,538 | A | 8/1983 | Johnson | |
| 4,440,174 | A | 4/1984 | Cordova | |
| 4,564,015 | A * | 1/1986 | Friedman | 450/31 |
| 5,478,278 | A | 12/1995 | Greenblatt | |
| 5,946,726 | A | 9/1999 | Green | |
| 6,113,460 | A | 9/2000 | McKeown | |
| 6,162,111 | A | 12/2000 | Heroff | |
| 6,282,719 | B1 * | 9/2001 | Vera et al. | 2/78.1 |
| 6,443,805 | B1 * | 9/2002 | Kirkwood | 450/31 |
| 6,530,820 | B1 | 3/2003 | Katze et al. | |
| 6,645,041 | B2 * | 11/2003 | Sørensen | 450/36 |
| 6,811,462 | B1 | 11/2004 | Kenneally | |
| 6,839,908 | B2 * | 1/2005 | Schneider et al. | 2/73 |
| 6,855,029 | B2 * | 2/2005 | Rothman | 450/36 |
| 6,983,489 | B2 * | 1/2006 | Caprio | 2/69 |
| 7,076,809 | B2 * | 7/2006 | Rothman | 2/104 |
| 7,077,720 | B2 * | 7/2006 | Schneider et al. | 450/36 |

OTHER PUBLICATIONS

Special Verdict Form, filed Nov. 5, 2007 in United States District Court for the District of New Jersey, Civil Action No. 3:05-cv-4829 (GEB) involving US patent 6,855,029.

GlamourMom's Rule 50 Motion for JMOL of Claim 12 of the '029 patent by Motherwear, filed Nov. 16, 2007.

GlamourMom's Rule 50 Motion for JMOL of No anticipation of the '029 patent, filed Nov. 16, 2007.

GlamourMom's Rule 50 Motion for JMOL that the Johstone Invention is Not Prior Art and Cannot Anticipate, filed Nov. 19, 2007.

GlamourMom's Rule 50 motion for JMOL That the '029 Patent is not Invalid by Obviousness, filed Nov. 19, 2007.

(Continued)

*Primary Examiner*—Gloria Hale
(74) *Attorney, Agent, or Firm*—Gottlieb Rackman & Reisman, PC

(57) ABSTRACT

A woman's garment includes an integral brassiere having improved breast support. The garment includes first and second bra cups in combination with an additional front support panel situated between the outer garment body and said first and second bra cups, said additional front support panel having a shape that substantially covers said first and second bra cups. The bra cups provide the support of a separate fitted brassiere. The additional front support panel provides both support for the bra cups and support for the outer garment body, which creates a smooth flattering appearance.

22 Claims, 3 Drawing Sheets

OTHER PUBLICATIONS

GlamourMom's Rule 50 Motion for JMOL of No Inequitable Conduct, filed Nov. 19, 2007.
Leading Lady's Opposition to GlamourMom's JMOL Motion That the '029 Patent is Not Invalid By Obviousness, Nov. 2007.
Leading lady's Opposition to GlamourMom's JMOL Motion of No Equitable Conduct, Nov. 2007.
Motherwear's Opposition to GlamourMom's JMOL Motion Concerning Non-Infringement, Nov. 2007.
Leading Lady's Opposition to GlamourMom's JMOL Motion re: Haidee Johnstone, Nov. 2007.
GlamourMom's Reply Brief in Support of Its JMOL Motion of No Equitable Conduct, filed Dec. 27, 2007, Dec. 2007.
GlamourMom's Reply Brief in Support of Its JMOL Motion of Infringement of Claim 12 of the '029 patent, filed Dec. 27, 2007.
GlamourMom's Reply Brief in Support of Its JMOL Motion of No Anticipation, filed Jan. 1, 2008.
GlamourMom's Reply Brief in Support of Its JMOL Motion re: The Johnstone Alleged Prior Invention, filed Jan. 2, 2008.
GlamourMom's Reply Brief in Support of Its JMOL Motion of Non-Obviousness, filed Jan. 2, 2008.
Kmart's Response Joining In and Adopting By Reference the Oppositions of Leading Lady to GlamourMom's JMOL Motions, Dec. 2007.
Leading Lady's Opposition to GlamourMom's JMOL Motion of No Anticipation by Certain References, Dec. 2007.
MemoOpinion.JudgeBrown.Doc338, Apr. 2008.
MemoOpinion.JudgeBrown.Doc340, Apr. 2008.
MemoOpinion.JudgeBrown.Doc342, Apr. 2008.
MemoOpinion.JudgeBrown.Doc344, Apr. 2008.
MemoOpinion.JudgeBrown.Doc346, May 2008.
OrderDenyingJMOLMotion.Doc339, Apr. 2008.
OrderDenyingJMOLMotion.Doc341, Apr. 2008.
OrderDenyingJMOLMotion.Doc343, Apr. 2008.
OrderDenyingJMOLMotion.Doc345, Apr. 2008.
OrderDenyingJMOLMotion.Doc347, May 2008.

* cited by examiner

GARMENT WITH SHELF BRA HAVING IMPROVED BREAST SUPPORT

FIELD OF THE INVENTION

The present invention relates to a women's garment having a bra that is built into the garment.

BACKGROUND OF THE INVENTION

Certain types of women's garments do not work well with a separate fitted brassiere (bra) undergarment. For example, when a regular brassiere is worn under a tank top, the shoulder straps of the tank top are typically too narrow to conceal the shoulder straps of the brassiere, creating an unsightly condition where the brassiere shoulder straps are visible.

Garments that include an internal brassiere in combination with an outer garment are known. For example, U.S. Pat. No. 4,398,538 to Johnson shows a women's soft fabric garment with integral brassiere.

Garments with a shelf bra built into the garment are known. For example, U.S. Pat. No. 4,440,174 to Cordova shows a tank top with a built in shelf bra formed by an elastic chest band coupled to the top edge or the tank top body by one or more fabric panels. The shelf bra and the tank top share a common pair of shoulder straps. However, the built in shelf bra by Cordova does not provide the support or shape as would be the case of a separate fitted brassiere.

SUMMARY OF THE INVENTION

A women's garment in accordance with the present invention comprises a garment with a shelf bra having improved breast support that is built into the garment. In particular, the improved breast support results from first and second bra cups in combination with an additional front support panel, said additional front support panel being situated between the outer garment body and said first and second bra cups, said additional front support panel having a shape that substantially covers said first and second bra cups. In such manner, the additional front support panel provides both improved breast support and improved garment shape as it supports the outer garment body to create a smooth, flattering bust line.

In accordance with one embodiment of the present invention a women's garment comprises the outer garment body having a front top edge and a rear top edge, first and second bra cups, an elastic chest band, first and second shoulder straps, a front support panel having a shape that substantially covers said first and second bra cups and a back panel that couples said elastic chest band to the rear top edge of said outer garment body.

The women's garment of the present invention may be embodied in a tank top in which the outer garment is made of elastic stretch material. Other types of women's garments in which the present invention may be embodied include strap evening gowns, pajamas, slips, dresses, swimsuits and the like. Although the present invented shelf bra having improved breast support works best in women's garments that have a narrow shoulder strap, the present invention may be used in combination with other types of women's garments.

DETAILED DESCRIPTION

Figure 1:
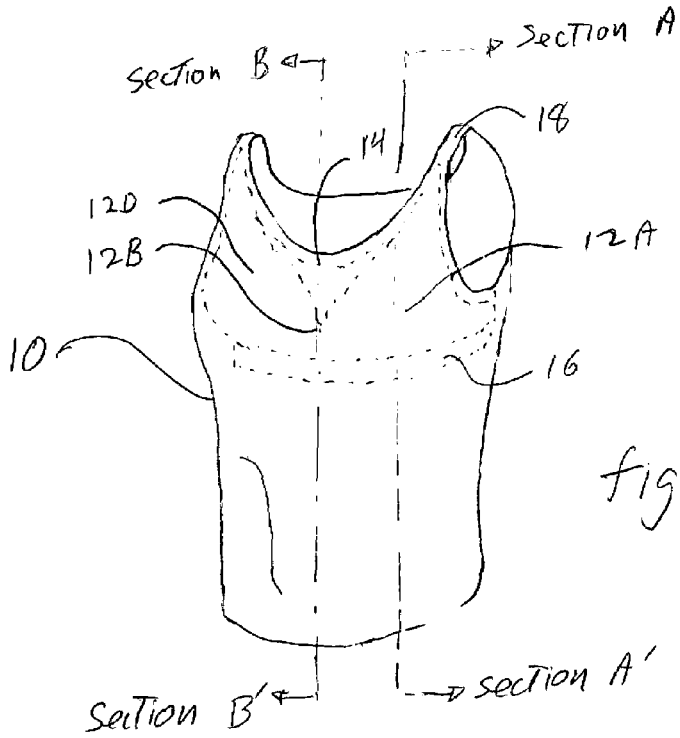
FIG. 1 is a women's tank top garment incorporating a built in shelf brassiere in accordance with the present invention.

A women's garment comprises an outer garment body 10 and an integral brassiere comprising an elastic band 16, respective bra cups 12A, 12D and respective shoulder straps 18 as shown FIG. 1. Additionally, the women's garment of the present invention includes an additional front support panel 14 situated between the outer garment body 10 and the respective bra cups 12A, 12D.

As used herein, bra cups 12A, 12D may be formed from an actual cup shaped material or individual fabric panels sewn into a cup shape, or may alternately be a flat piece of elastic material that gives way to form a cup when pressed against the women's breast. The two bra cups 12A, 12D are attached at the bottom edge thereof to the elastic chest band 16 and to each other at the cleavage edges thereof 12B.

Figure 2:
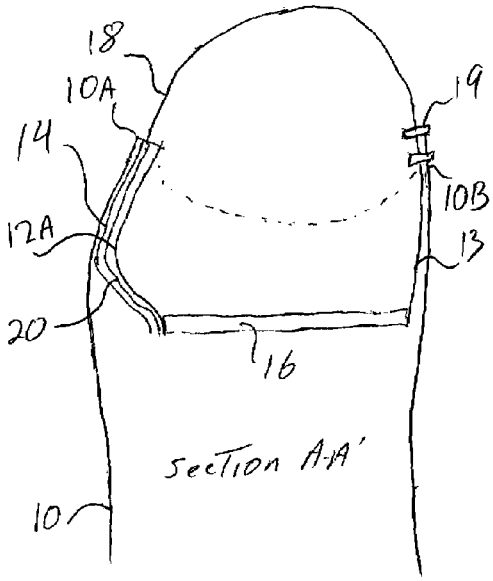
FIG. 2 is a first cross sectional view of the garment of FIG. 1 in accordance with the present invention.

A cross sectional view A-A' where the women's breast contacts the garment is illustrated in FIG. 2. The innermost layer is the breast cup 12A. The outermost layer is the outer garment body 10. In between the breast cup 12A and the outer garment body 10, there is an additional front support panel 14. Optionally, a mesh fabric panel is sewn into the additional front support panel 14 as a liner 20 having substantially the same shape as, and coincident with, said front support panel. Shoulder straps 18 attach at one end thereof to the rear top edge 10B of the outer garment body 10 (via an adjustable length portion 19) and at the other end thereof to the front top edge 10A, where the top of the breast cup 12A and the top of the additional front support panel 14 and optional mesh liner 20 combination are joined. A back panel 13 connects the back section of the elastic chest band 16 to the rear top edge 10B of the outer garment body 10.

Figure 3:
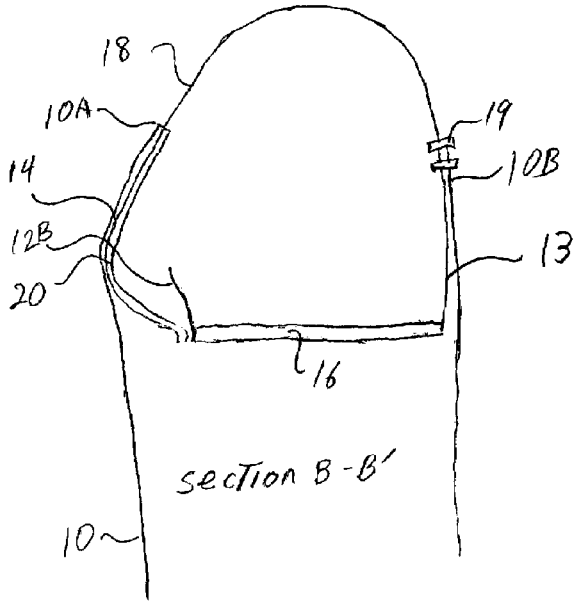
FIG. 3 is a second cross sectional view of the garment of FIG. 1 in accordance with the present invention.

A cross sectional view B-B' through the center of the garment (where the cleavage area between the women's breasts contacts the garment) is illustrated in FIG. 3. At the middle of the garment, the innermost layer is where the cleavage edges of bra cups 12A and 12D are joined together at 12B.

Figure 6:
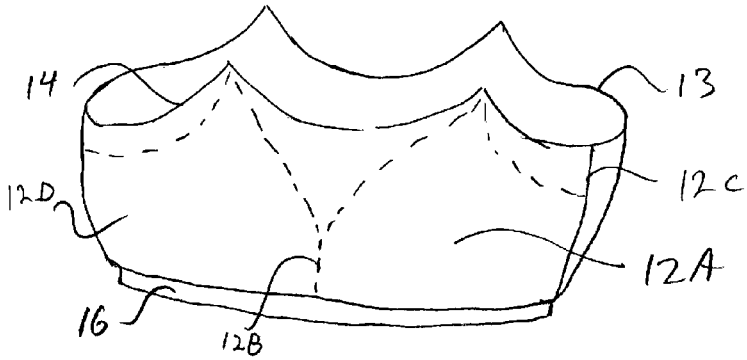
FIG. 6 is perspective view of the internal portion of a built in shelf brassiere in a women's garment in accordance with the present invention.

The internal shelf bra with improved breast support is shown separate from the outer garment body in FIG. 6. The back panel 13 is joined at the edges thereof 12C to the front support panel 14, which in turn is joined at the bottom edges thereof to the elastic chest band 16. Just behind the front support panel 14, are the two bra cups 12A, 12D, which are also attached at the bottom edges thereof to the elastic chest band 16.

Figure 4:
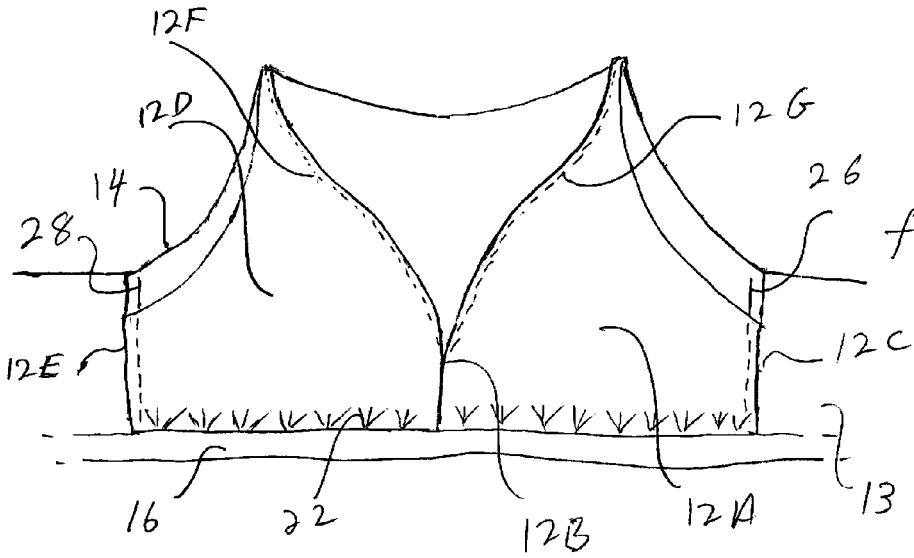
FIG. 4 is a partial internal view of a built in shelf brassiere in a women's garment in accordance with the present invention.
Figure 5:
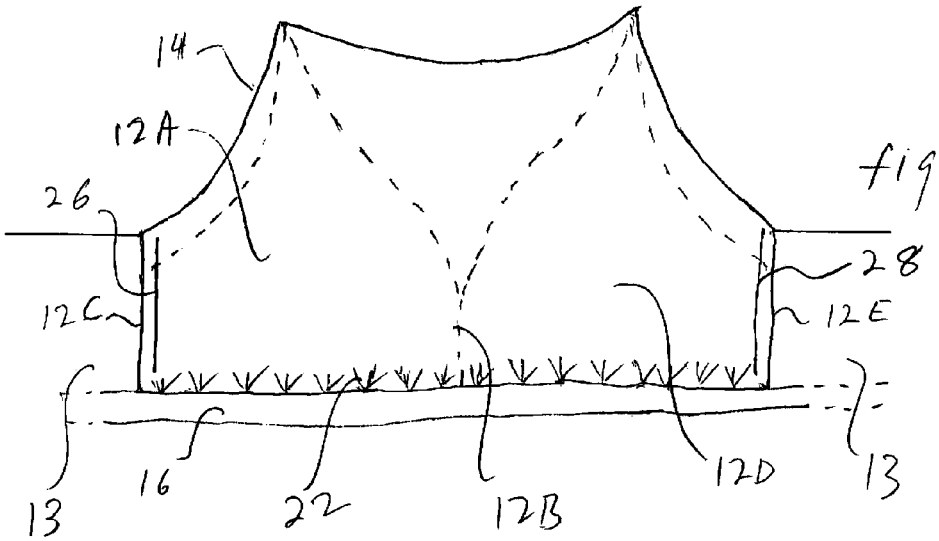
FIG. 5 is a partial external view of a built in shelf brassiere in a women's garment in accordance with the present invention.

An internal view of the shelf bra with improved breast support is shown in FIG. 4. An external view of the shelf bra with improved breast support is shown in FIG. 5. Bra cups 12A, 12D are shown with optional fabric puckers 22 where the fabric is gathered as it is sewn to the elastic chest band 16. The back piece 13 is connected at the side edges thereof 12C, 12E to the side edges of the front support panel 14. The respective side edges of the bra cups 12A, 12D may preferably be also sewn at the same seems 12E, 12C. The respective cleavage edges of the bra cups 12A, 12D may preferably be also sewn together at seam 12B.

The bra cups 12A, 12D provide the wearer with the support of a separate fitted brassiere. The additional front support panel 14 provides both support for the women's breasts and support for the outer garment body 10, which creates a smooth flattering appearance.

Optional Mesh Liner for Greater Comfort and Support

Mesh liner 20 is preferably made of non-absorbent stretchable nylon fabric. The outer garment body 10, the additional front support panel 14 and the bra cups 12A, 12D, are preferably made of a cotton/Lycra-type stretch fabric blend. The mesh liner 20 provides both additional breast support and makes the garment more breathable, substantially increasing the comfort of the wearer.

First, there is excellent breast support because there are three layers of fabric supporting the breast, i.e., 1) the bra cups 12A, 12D, 2) the additional front support panel 14 and 3) the outer garment body 10. Optionally for four layers of support, the optional mesh liner 20 is used. The garment is thus more breathable and comfortable to wear because the optional mesh layer 20 provides for increased airflow.

Figure 7:
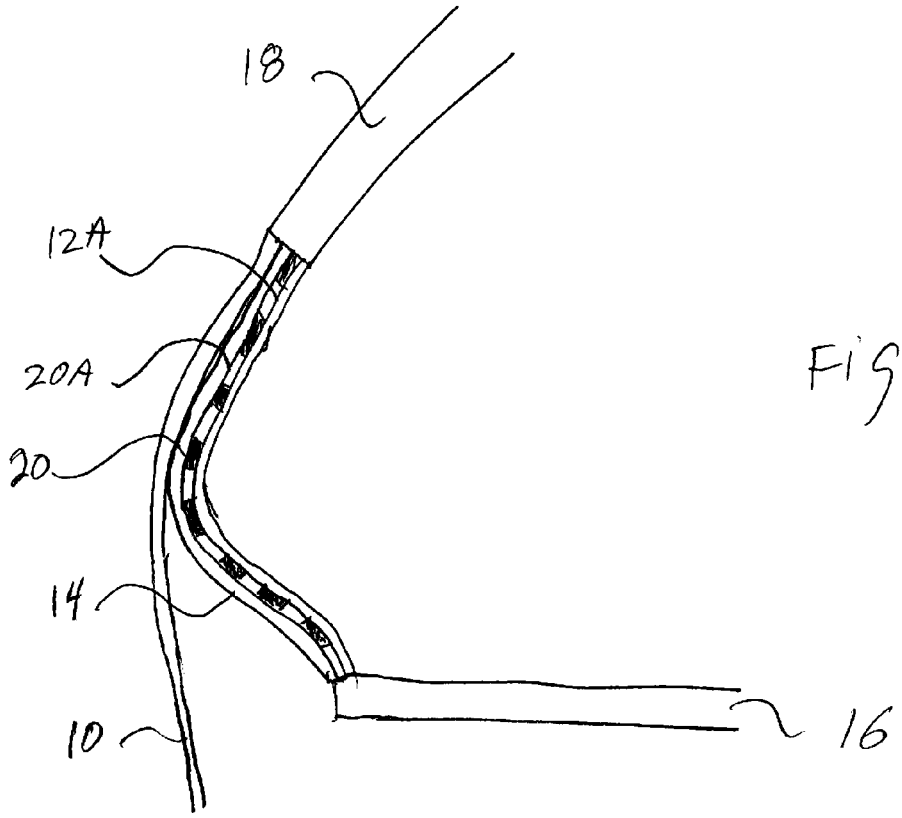
FIG. 7 illustrates further detail of the cross sectional view from FIG. 2.

FIG. 7 illustrates the construction details. Specifically, mesh liner 20 is sandwiched between the additional front support panel 14 and the bra cup 12A. Openings 20A in mesh liner 20 allow air and moisture (water vapor) from exposed skin (as well as air and moisture passing through the bra cup fabric 12A) to escape from the garment.

Figure 8:
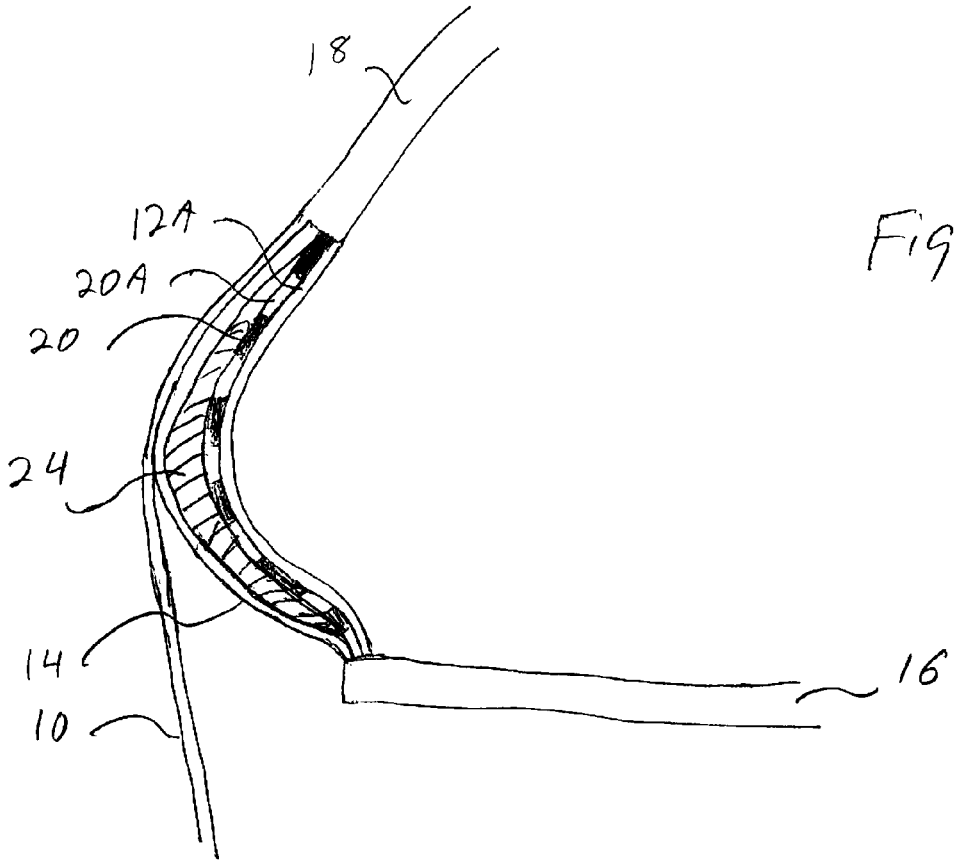
FIG. 8 illustrates further the placement of a breast pad in the cross sectional view shown by FIG. 7.

FIG. 8 illustrates a breast pad 24 placed between the additional front support panel 14 and the mesh liner 20, transforming the garment into a padded bra tank. To insert a breast pad 24, between the additional front support panel 14 and the mesh liner 20, a slit, i.e., an opening (26, 28 in FIGS. 4 and 5) is provided in the mesh liner 20. The breast pad 24 is held in place by the additional front support panel 14 and the mesh liner 20.

To prevent the breast pad 24 from moving within the space between the mesh liner 20 and the additional front support panel 14, the mesh liner 20 may be sewn to the additional front support panel 14. In particular, the sewn seams 12F and 12G (FIG. 4) show stitching (following the line of the top edge of bra cups 12A and 12D) where the mesh liner 20 is attached to the additional front support panel 14. Because the sewn seams 12F and 12G tend to isolate the region between the additional front support panel 14 and the mesh liner 20 adjacent to first bra cup 12A, from the region between the additional front support panel 14 and the mesh liner 20 adjacent to second bra cup 12D, the breast pad 24 cannot migrate between the regions adjacent to the first and second bra cups 12A, 12D. The breast pad 24A may be just a small nipple shield, or a larger pad for increased bust line or any other type of insert.

Mesh liner 20 may be substantially coincident with the additional front support panel 14 (i.e., as a full liner) or may be placed to substantially cover bra cups 12A and 12D only. In yet another alternate configuration, the mesh liner 20 is substantially coincident with the first and second bra cups and is sewn to the first and second bra cups. In the latter embodiment, seams 12F and 12G represent where the mesh liner 20 is sewn to the first and second bra cups 12D, 12A respectively.

In either case, mesh liner 20 provides for both increased breast support at the same time as providing improved air and water vapor flow within and through the garment, thereby increasing the comfort of the wearer.

What is claimed is:

1. A garment with an integral brassiere comprising:

first and second bra cups having respective top and bottom edges;

an elastic chest band having a front region and a back region, said bottom edges of said first and second bra cups being connected to said front region of said elastic chest band;

first and second shoulder straps each having a respective front end and back end, said front end of said first shoulder strap being connected to said top edge of said first bra cup, said front end of said second shoulder strap being connected to said top edge of said second bra cup;

a front support panel having a top edge, a bottom edge and first and second side edges, said front support panel having a shape that substantially covers said first and second bra cups, said front support panel being connected at said top edge thereof to said front end of said first shoulder strap, said front support panel being connected at said top edge thereof to said front end of said second shoulder strap, said bottom edge of said front support panel being connected to said front region of said elastic chest band; and a garment body having a front top edge and a rear top edge, said front top edge being non-releasably connected to said front end of said first shoulder strap and said front end of said second shoulder strap, said garment body forming an outer garment which extends below said elastic chest band and substantially covers the wearer's torso.

2. A garment in accordance with claim 1, wherein said rear top edge of said garment body is connected to said back end of said first shoulder strap and wherein said rear top edge of said garment body is connected to said back end of said second shoulder strap.

3. A garment in accordance with claim 2, wherein each of said first and second shoulder straps further comprise a respective first and second adjustable length section.

4. A garment in accordance with claim 3, wherein said back end of said first shoulder strap is coupled to said back region of said elastic chest band and said back end of said second shoulder straps is coupled to said back region of said elastic chest band.

5. A garment in accordance with claim 4, wherein said back end of said first shoulder strap and said back end of said second shoulder strap are coupled to said back region of said elastic chest band by a back panel, said back panel having a top edge and a bottom edge and respective first and second side edges, said top edge of said back panel being connected to said back end of said first shoulder strap, said top edge of said back panel being connected to said back end of said second shoulder strap, and said bottom edge of said back panel being connected to said back region of said elastic chest band.

6. A garment in accordance with claim 5, wherein said first side edge of said front support panel is connected to said first side edge of said back panel and said second side edge of said front support panel is connected to said second side edge of said back panel.

7. A garment in accordance with claim 6, wherein said first and second bra cups are separate pieces of fabric each having a respective cleavage edge and a respective side edge, said first side edge of said back panel being connected to said side edge of said first bra cup and said second side edge of said back panel being connected to said side edge of said second bra cup.

8. A garment in accordance with claim 7, wherein said cleavage edge of said first bra cup is connected to said cleavage edge of said second bra cup.

9. A garment with an integral brassiere comprising:

first and second bra cups having respective top and bottom edges;

an elastic chest band having a front region and a back region, said bottom edges of said first and second bra cups being connected to said front region of said elastic chest band;

first and second shoulder straps each having a respective front end and back end, said front end of said first shoulder strap being connected to said top edge of said first bra cup, said front end of said second shoulder strap being connected to said top edge of said second bra cup;

a front support panel having a top edge, a bottom edge and first and second side edges, said front support panel having a shape that substantially covers said first and second bra cups, said front support panel being connected at said top edge thereof to said front end of said first shoulder strap, said front support panel being connected at said top edge thereof to said front end of said second shoulder strap, said bottom edge of said front support panel being connected to said front region of said elastic chest band;

a mesh fabric panel situated between said front support panel said and first and second bra cups; and a garment body having a front top edge and a rear top edge, said front top edge being non-releasably connected to said front end of said first shoulder strap and said front end of said second shoulder strap, said garment body forming an outer garment which extends below said elastic chest band and substantially covers the wear's torso.

10. A garment in accordance with claim 9, wherein said mesh fabric panel is substantially coincident with said front support panel.

11. A garment in accordance with claim 10, wherein said rear top edge of said garment body is connected to said back end of said first shoulder strap and wherein said rear top edge of said garment body is connected to said back end of said second shoulder strap.

12. A garment in accordance with claim 11, wherein each of said first and second shoulder straps further comprise a respective first and second adjustable length section.

13. A garment in accordance with claim 12, wherein said back end of said first shoulder strap is coupled to said back region of said elastic chest band and said back end of said second shoulder straps is coupled to said back region of said elastic chest band.

14. A garment in accordance with claim 13, wherein said back end of said first shoulder strap and said back end of said second shoulder strap are coupled to said back region of said elastic chest band by a back panel, said back panel having a top edge and a bottom edge and respective first and second side edges, said top edge of said back panel being connected to said back end of said first shoulder strap, said top edge of said back panel being connected to said back end of said second shoulder strap, and said bottom edge of said back panel being connected to said back region of said elastic chest band.

15. A garment in accordance with claim 14, wherein said first side edge of said front support panel is connected to said first side edge of said back panel and said second side edge of said front support panel is connected to said second side edge of said back panel.

16. A garment in accordance with claim 15, wherein said first and second bra cups are separate pieces of fabric each having a respective cleavage edge and a respective side edge, said first side edge of said back panel being connected to said side edge of said first bra cup and said second side edge of said back panel being connected to said side edge of said second bra cup.

17. A garment in accordance with claim 16, wherein said cleavage edge of said first bra cup is connected to said cleavage edge of said second bra cup.

18. A garment in accordance with claim 9, wherein said mesh fabric panel has an opening therein to allow a breast pad to be inserted between said mesh fabric panel and said front support panel.

19. A garment in accordance with claim 18, wherein said mesh fabric panel is sewn to said front support panel so as to restrain said breast pad from migrating between the region formed by said front support panel and said first bra cup and the region formed by said front support panel and said second bra cup.

20. A garment in accordance with claim 9, wherein said mesh fabric panel is substantially coincident with said first and second bra cups.

21. A garment in accordance with claim 20, wherein said mesh fabric panel has an opening therein to allow a breast pad to be inserted between said mesh fabric panel and said first bra cup.

22. A garment in accordance with claim 20, wherein said mesh fabric panel is sewn to said first and second bra cups so as to restrain said breast pad from migrating between the region formed by said mesh fabric panel and said first bra cup and the region formed by said mesh fabric panel and said second bra cup.

* * * * *